United States Patent [19]

Rascov

[11] Patent Number: 4,685,612

[45] Date of Patent: Aug. 11, 1987

[54] MAILBOX INDICATOR

[76] Inventor: Anthony J. Rascov, 4303 Robasco Rd., Cincinnati, Ohio 45244

[21] Appl. No.: 819,418

[22] Filed: Jan. 16, 1986

[51] Int. Cl.[4] ..... B65D 91/00

[52] U.S. Cl. ..... 232/35; 232/17; 40/312

[58] Field of Search ..... 232/35, 17, 36; 40/312, 40/313

[56] References Cited

U.S. PATENT DOCUMENTS

| | | | |
|---|---|---|---|
| 1,458,836 | 6/1923 | McDowell | 232/35 |
| 2,681,762 | 6/1954 | Long et al. | 232/35 |
| 2,812,130 | 11/1957 | Abell | 232/35 |
| 3,095,140 | 6/1963 | Buedingen | 232/35 |
| 4,113,170 | 9/1978 | Hunsicker | 232/35 |
| 4,138,056 | 2/1979 | Sherrill | 232/35 |
| 4,552,302 | 11/1985 | Rung | 232/35 |

*Primary Examiner*—Gene Mancene

*Assistant Examiner*—Wenceslao J. Contreras

*Attorney, Agent, or Firm*—Frost & Jacobs

[57] ABSTRACT

One embodiment of the present invention concerns a plate having a coil spring indicator positioned thereon and a retaining means for retaining the indicator from its normal vertical position to a horizontal position. A pair of such plates are adapted to be mounted upon the side of a mailbox. In another embodiment of the present invention, a conventional rural mailbox is initially manufactured with a pair of spring loaded indicators positioned on the side of the mailbox and having a pair of retainer means being positioned between the spring loaded indicator and the door of the mailbox. By using a pair of spring loaded indicators, the present device indicates when mail has been deposited by the resident in the mailbox for pickup by the mailman, and when mail has been deposited by the mailman for pickup by the resident.

9 Claims, 5 Drawing Figures

MAILBOX INDICATOR

BACKGROUND OF THE INVENTION

1. Field of the Invention.

The present invention relates to a device to be mounted on a mailbox indicating when the owner has deposited mail for pickup by the mailman and indicating when the mailman has deposited mail for pickup by the owner. In particular, the present invention concerns a device which may be mounted on a plate and attached to the side of an existing mailbox or initially manufactured with each mailbox, including a pair of spring loaded bobbins used as indicators which in the relaxed position project upwardly from the mailbox giving it a dog-eared appearance.

2. Prior Art.

Convention rural mailboxes are typically mounted on a post adjacent the road so that a mailman can stop and deposit mail for various residences along the rural route. Conventional mailboxes include a red colored indicator which can be positioned either vertically or horizontally. When mail has been deposited by a resident along a rural route for pickup by the mailman, the resident raises the red colored indicator from the horizontal position to the vertical position. This informs the mailman that mail has been deposited in the mailbox for pickup and delivery. When the mailman has picked up the deposited mail of the resident, the mailman lowers the red colored indicator from the vertical position to the horizontal position, thus repositioning it for future use.

A need exists with respect to indicators for rural mailboxes, to indicate not only when mail has been deposited by a resident for pickup by the mailman, but to also indicate when mail has been deposited by the mailman for the resident.

One problem with conventional red colored mailbox indicators is the fact that they are primarily two-dimensional, i.e., the indicators are very thin and are oriented such that one of the thin edges faces the resident while the much larger dimensions of height and width are generally in a plane perpendicular to the road so as to be easily visible to the mailman.

Another aspect of the present invention is to form the indicator in a three-dimensional shape which can easily be seen, equally, in any direction, including a direction above the mailbox as well as directly behind the mailbox.

SUMMARY OF THE INVENTION

In one embodiment of the present invention, a pair of plates, one being left-handed and the other being right-handed, are designed to be mounted upon the sides of a mailbox with screws or other suitable fasteners. Each plate includes a coil spring attached to a colored indicator which is vertically oriented in the relaxed position. The coil spring and indicator are positioned toward the center of the mailbox. The plate also includes a perpendicular, laterally projecting buttress having a lower horizontal ledge. The lateral buttress is positioned on the plate so that, when the plate is properly mounted, the buttress is positioned adjacent the front of the mailbox.

In another embodiment of the present invention, a conventional rural mailbox is manufactured with a pair of coil springs positioned in an embossed keeper which is directly mounted on each side of the mailbox. Each coil spring and keeper being a mirror image of one another. Additionally, a lateral buttress is positioned on each side and near the front of the mailbox. The lateral buttress has a lower horizontal ledge.

In the broadest sense, the present invention relates to a dog-eared indicator for a mailbox comprising a pair of coil springs, a coil spring positioned on each side of a mailbox, each coil spring including a colored indicator mounted on the free end, such that when the coil spring is in the relaxed position, the indicator is vertically oriented above the height of the mailbox; and a pair of lateral buttresses, one each being positioned laterally on the side of the mailbox adjacent the front thereof, each lateral buttress including a lower horizontal ledge. When the indicator is placed in a horizontal position, a portion of the coil spring resides beneath the lower horizontal ledge and the indicator itself projects beyond the door of the mailbox.

These and other concepts of the present invention will be easily understood by referencing the enclosed drawings and the following description.

BRIEF DESCRIPTION OF THE DRAWINGS

The drawings are intended to illustrate the preferred embodiments of the present invention, but are not intended to encompass all the various modifications thereof.

DESCRIPTION OF THE PREFERRED EMBODIMENTS

Figure 1:
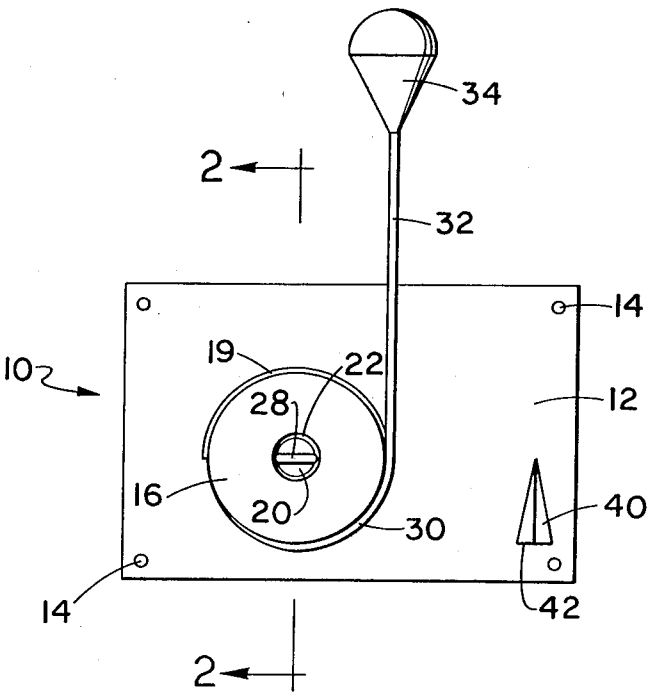
FIG. 1 is an elevational front view of the left-hand adapter plate, including a dog-eared indicator and a lateral buttress positioned thereon.

Illustrated in FIG. 1 is one embodiment of the present invention. This embodiment is designed to permit conversion of a standard rural mailbox into a mailbox of the present invention. The conversion unit is generally represented by reference numeral 10 in FIG. 1. The conversion unit 10 includes a rectilinear thin plate 12 made of plastic, synthetic resin, a composition or preferably metal. The plate illustrated in FIG. 1 is a left-hand plate and is designed to be secured to the left side (when facing the door of the mailbox) of a conventional mailbox in any known manner such as with adhesives or with sheetmetal screws. A plurality of holes 14 may be drilled through the plate 12 to permit attachment of the plate to the side of the mailbox.

Figure 2:
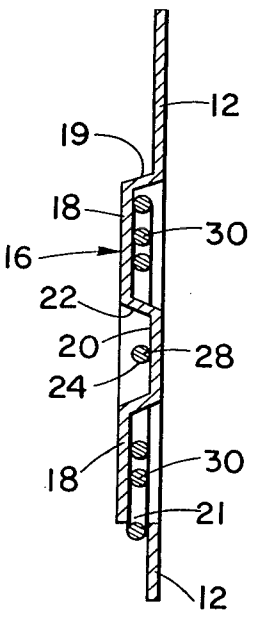
FIG. 2 is an enlarged cross-sectional side view through the coil spring of the indicator as taken along line 2—2 in FIG. 1.

A circular keeper 16 is mounted upon plate 12 in any conventional manner. As illustrated in FIG. 2, for example, the keeper 16 is formed integrally with the plate 12. The keeper 16 comprises an arcuate embossed projection 18 which is offset from the plane of the plate 12 a slight distance, as illustrated in FIG. 2. The center 20 of the keeper 16 is recessed or otherwise planar with the plate 12. As illustrated in FIG. 2, a connecting wall portion 19 extends between the plate 12 and the arcuate embossed projection 18, thus preventing any water from running between the keeper 16 and the plate 12. The lower portion of the keeper 16 has an opening 21, the purpose of which will be explained later. Between the center 20 and the arcuate embossed projection 18 is a tapered wall 22 having at least one hole 24 drilled therethrough. Preferably, however, the tapered wall 22 includes a pair of diametrically opposed holes 24, the purpose of which will be explained later.

Figure 3:
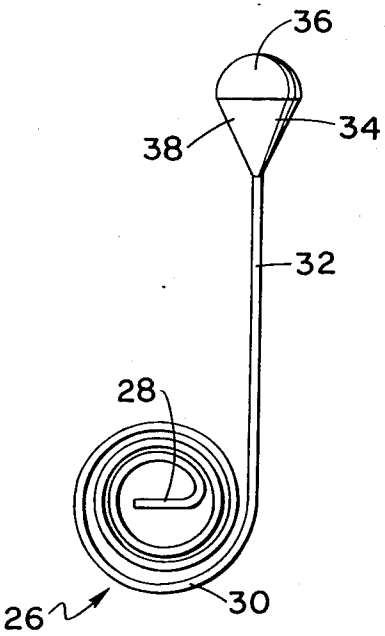
FIG. 3 is an elevational view of the coil spring and indicator with the keeper being removed.

FIG. 3 illustrates a coil spring illustrated generally by reference numeral 26 which comprises a short linear end 28 centrally positioned within the concentric convolutions 30 of the coil spring 26. The other end 32 of the coil spring 26 is also linear and is substantially longer in length than the short linear end 28. Attached to the long linear end 32 is a dog-eared indicator 34 preferably having either a red or bright yellow color. While it is preferred that the coil spring 26 be made of spring steel, for example, it is also preferred that the dog-eared indicator 34 be made of a hard rubber or any other material capable of withstanding a year-around outdoor environment. Althoguh the dog-eared indicator 34 includes a semispherical top portion 36 and a cone-shaped bottom portion 38, the dog-eared indicator 34 could be any shape which can easily be detected in any direction of viewing.

The coil spring 26 and the dog-eared indicator 34 are mounted upon the plate 12 by inserting the short linear end 28 into the hole or holes 24 of the tapered wall portion 22 of the keeper 16 and permitting the concentric spring convolutions 30 to lie within the arcuate embossed projection 18.

The outermost concentric spring convolutions 30, which is integrally formed with the long linear end 32, projects out through the opening 21 in the keeper 16 so that the long linear end 32 is positioned outside the keeper 16 and is vertically oriented when plate 12 is properly mounted upon the side of a mailbox. The coil spring 26 permits the dog-eared indicator 34 to be positioned in any direction planar with plate 12. However, upon releasing the dog-eared indicator 34 from any position, the coil spring will return it to its normal, vertically oriented position.

The plate 12 is provided with a lateral buttress 40 which is securely attached near an edge of plate 12, which when properly positioned on the side of a mailbox, is adjacent the front of the mailbox. The lateral buttress 40 includes a horizontal lower ledge 42 which is substantially planar with a horizontal tangent of the opening 21 of keeper 16 when the plate 12 is properly positioned on the side of a mailbox.

Converting a conventional rural mailbox to the mailbox of the present invention also requires that a right-hand plate, which is a mirror image of the left-hand plate, also be attached to the conventional rural mailbox. In other words, both sides of the rural mailbox will include a plate 12 with a dog-eared indicator 34 and a lateral buttress 40 positioned thereon.

Figure 5:
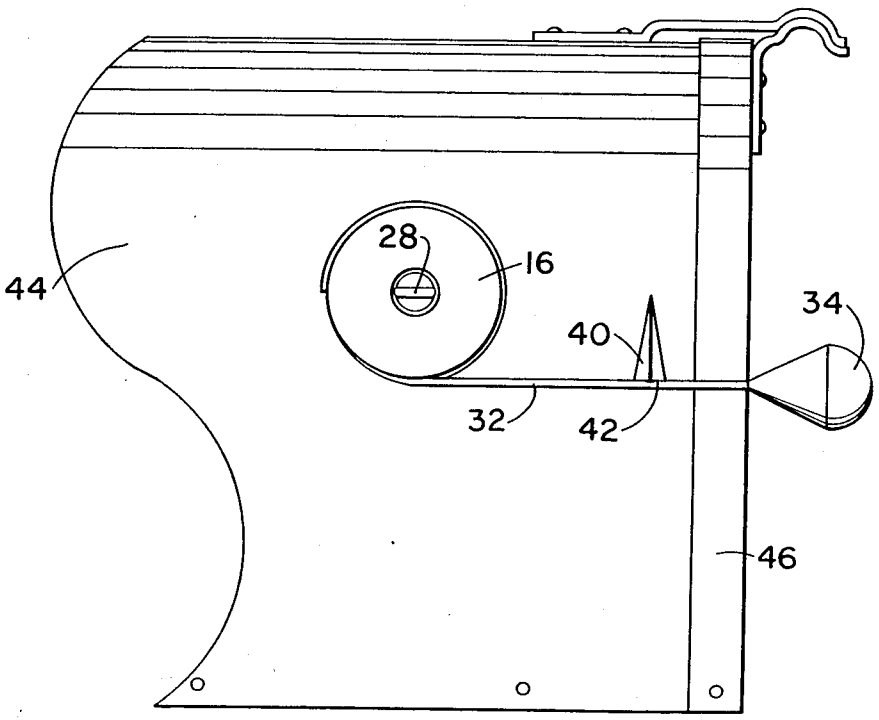
FIG. 5 is a fragmentary side view of a rural mailbox illustrating only one of the two indicators positioned beneath the lower horizontal ledge of the lateral buttress so that it projects beyond the front of the mailbox.
Figure 4:
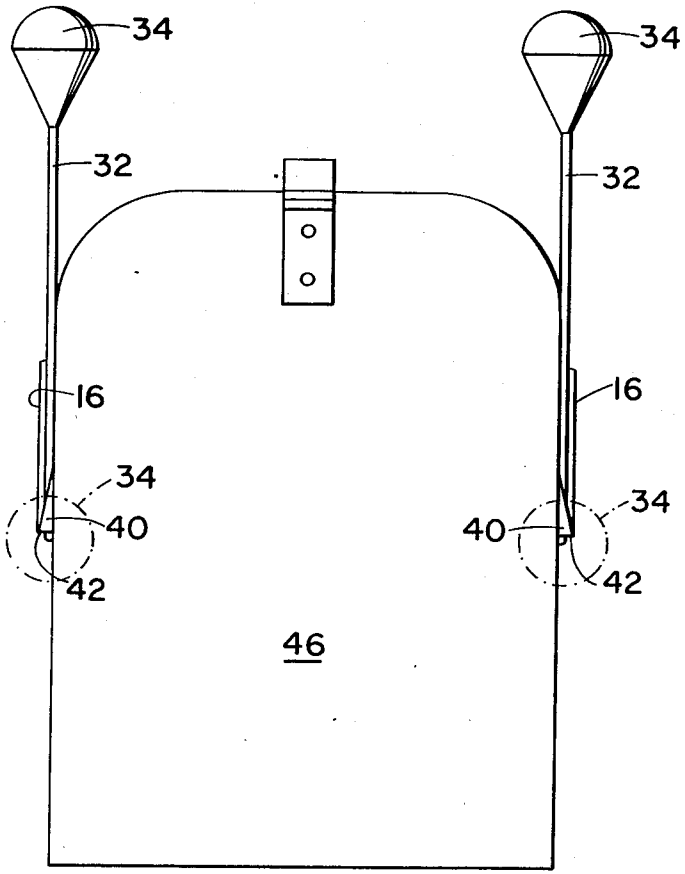
FIG. 4 is a front elevational view of a conventional mailbox with a pair of dog-eared indicators initially formed or manufactured on the sides of the mailbox.

FIGS. 4 and 5 indicate a rural mailbox 44 having a conventional front door lid 46 and further including a coil spring 26 and a dog-eared indicator 34 along with a lateral buttress 40, all of which are formed initially during manufacturing of the mailbox 44. The operation and the components of the manufactured mailbox 44 is the same as the converted mailbox, except that plate 12 is replaced by the sides of the mailbox.

In operation, it is preferred that the left-handed dog-eared indicator 34 be bright yellow in color while the right-handed dog eared indicator 34 (see FIG. 4) be of a different color, such as the conventional red color. When the resident has mail to be picked up by the postman, the resident deposits the mail in the mailbox and pulls the left-handed yellow dog-eared indicator 34 down toward the front of the mailbox, i.e., toward the lid 46 and places the long linear end 32 beneath the horizontal lower ledge 42 of the lateral buttress 40. The lower ledge 42 is capable of maintaining the dog-eared indicator 34 and the long linear end 32 in a substantially horizontal position so that the dog-eared end 34 projects beyond the lid or door 46 of the mailbox when it is in the closed position, as illustrated in FIG. 5. This indicates to the postman that mail has been deposited in the mailbox by the resident for pickup by the postman. When the postman opens the door 46 of the mailbox 44, the door moves the dog-eared indicator 34 laterally, a slight distance, since the dog-eared indicator is partly positioned in front of the door 46, as is shown in phantom in FIG. 4. When the door 46 moves the dog-eared indicator 34 laterally, the long linear end 32 is no longer restrained by the lower ledge 42 of the lateral buttress 40 because it has been shifted laterally beyond the lower ledge 42. The coil spring causes the dog-eared indicator 34 to be recoiled in its initial position, i.e., oriented vertically as illustrated in FIG. 4. Accordingly, a resident who has deposited mail in the mailbox for pickup by the postman and has positioned the left-handed yellow dog-eared indicator 34 as shown in phantom in FIG. 4, will know when the postman has picked up the mail by merely noting that the yellow dog-eared indicator is now vertically oriented.

On the other hand, if the postman deposits mail into the mailbox for the resident, the postman moves the right-handed dog-eared indicator 34, which may be red in color, into a horizontal position as illustrated in phantom in FIG. 4. In this manner, the resident can view the mailbox from a distance and note that the red-colored right-handed dog-eared indicator 34 is not in the vertical position and thus the mailman has deposited mail in the mailbox. This procedure prevents the resident from making unnecessary trips to the mailbox to determine if any mail has been deposited by the mailman. This feature is particularly valuable to the resident during the cold winter months or during the rainy wet season.

In summary, the present invention provides a method of indicating to the mailman when the resident has deposited mail in the mailbox for pickup by the mailman and provides an indication to the resident when the mailman has deposited mail in the mailbox for the resident.

Modifications of the present invention may be made without departing from the spirit of it. For example, rather than using a coil spring to return the dog-eared indicator to the vertical position, a conventional linear spring could also be employed.

What is claimed is:

1. An indicator for a conventional rural mailbox having a conventional end door shiftable between opened and closed positions, said indicator comprising an elongated resilient rectilinear member having a first end formed into a plurality of coiled coplanar convolutions terminating in an endmost portion located centrally within said convolutions and coplanar therewith, said indicator having a second end, an enlarged element affixed to said second end, means to mount said endmost portion of said first indicator end to a first side of said mailbox such that said indicator normally extends substantially vertically with respect to said mailbox with said enlarged element above said mailbox, said coiled first end of said indicator biasing said indicator to said vertical position, a laterally extending buttress on said first side of said mailbox, said buttress having a lower horizontal ledge, said indicator being shiftable against the action of said coiled second end thereof to a substantially horizontal position, said indicator being engageable beneath said buttress horizontal ledge to maintain it in said substantially horizontal position, said enlarged element, when said indicator is in said horizontal position, being located forwardly beyond said mailbox door and lying partially within the path of travel of said mailbox door from its closed to its open position, whereby when said indicator is in said horizontal position and said door is shifted from said closed to said open position, said door will engage said enlarged element and shift said indicator laterally by an amount sufficient to release said indicator from beneath said buttress ledge, causing said indicator to return to its normal vertical position under the urging of said coiled first end.

2. The structure claimed in claim 1 wherein said means to affix said coiled first end of said indicator to said first mailbox side comprises a circular embossed projection formed in said first mailbox side and extending outwardly of the plane thereof, said embossed projection having a peripheral opening facing downwardly of said mailbox, said coiled first end of said indicator being located within said embossed projection adjacent the inside surface thereof with a part of the outermost convolution of said coiled first end extending through said peripheral opening of said embossed projection and the remainder of said indicator located exteriorly thereof, and means to anchor the endmost portion of said coiled indicator first end centrally of said embossed projection.

3. The structure claimed in claim 1 wherein said means to affix said coiled first end of said indicator to said first mailbox side comprises a planar plate affixed to said first mailbox side, said plate having an inside surface adjacent the exterior surface of said first mailbox side and an exterior surface, a circular embossed projection formed in said plate and extending outwardly of said exterior plate surface, said embossed projection having a peripheral opening facing downwardly of said mailbox, said coiled first end of said indicator being located within said embossed projection between the inside surface thereof and the adjacent exterior surface of said mailbox first side with a part of the outermost convolution of said coiled first end extending through said peripheral opening of said embossed projection and the remainder of said indicator located exteriorly thereof, means to anchor the endmost portion of said coiled indicator first end centrally of said embossed projection, and said buttress being formed on said plate.

4. The structure claimed in claim 1 wherein said enlarged element of said indicator is three-dimensional.

5. The structure claimed in claim 1 including a second indicator substantially identical to first mentioned indicator and comprising an elongated resilient rectilinear member having a first end formed into a plurality of coiled coplanar convolutions terminating in an endmost portion located centrally within said convolutions and coplanar therewith, said second indicator having a second end, an enlarged element affixed to said second indicator second end, means to mount said endmost portion of said second indicator first end to a second side of said mailbox such that said indicator normally extends substantially vertically with respect to said mailbox with its enlarged element above said mailbox, said coiled first end of said second indicator biasing said second indicator to said vertical position, a laterally extending buttress on said second mailbox side, said buttress of said second mailbox side having a lower horizontal ledge, said second indicator being shiftable against the action of its coiled first end to a substantially horizontal position, said second indicator being engageable beneath the horizontal ledge of said buttress of said second mailbox side to maintain said second indicator in said substantially horizontal position, said enlarged element of said second indicator, when said indicator is in said horizontal position, being located forwardly beyond said mailbox door and lying partially within the path of travel of said mailbox door from its closed to its open position, whereby when said second indicator is in said horizontal position and said mailbox door is shifted from said closed to said open position, said mailbox door will engage said enlarged element of said second indicator and shift said second indicator laterally by an amount sufficient to release said second indicator from beneath said ledge of said buttress on said second mailbox side, causing said second indicator to return to its normal vertical position under the urging of its coiled first end.

6. The structure claimed in claim 5 wherein said means to affix said coiled first ends of said first mentioned indicator and said second indicator to said first and second mailbox sides respectively comprises first and second embossed projections formed in said first and second mailbox sides respectively, each of said first and second circular projections extending outwardly of the plane of its respective mailbox side, each of said first and second circular projections having a peripheral opening facing downwardly of said mailbox, said coiled first end of said first mentioned indicator being located within said first embossed projection adjacent the inside surface thereof with a part of the outermost convolution of said coiled first end of said first mentioned indicator extending through said peripheral opening of said first embossed projection and the remainder of said first mentioned indicator located exteriorly thereof, means to anchor the endmost portion of said coiled first end of said first mentioned indicator centrally of said first embossed projection, said coiled first end of said second indicator being located within said second embossed projection adjacent the inside surface thereof with a part of the outermost convolution of said coiled first end of said second indicator extending through said peripheral opening of said second embossed projection and the remainder of said second indicator located exteriorly thereof, and means to anchor the endmost portion of said coiled first end of said second indicator centrally of said second embossed projection.

7. The structure claimed in claim 5 wherein said means to affix said coiled first ends of said first mentioned indicator and said second indicator to said first and second mailbox sides respectively comprises first and second planar plates affixed to said first and second mailbox sides respectively, each of said first and second plates having an inside surface adjacent the exterior surface of its respective mailbox side and an exterior surface, a circular embossed projection formed in each of said first and second plates and extending outwardly of the exterior surface thereof, each of said embossed projections having a peripheral opening facing downwardly of said mailbox, said coiled first end of said first mentioned indicator being located within said embossed projection of said first plate between the inside surface thereof and the adjacent exterior surface of said mailbox first side with a part of the outermost convolution of said coiled first end of said first mentioned indicator extending through said peripheral opening of said embossed projection of said first plate and the remainder of said first mentioned indicator being located exteriorly thereof, means to anchor the endmost portion of said coiled first end of said first mentioned indicator centrally of said embossed projection of said first plate, said coiled first end of said second indicator being located within said embossed projection of said second plate between the inside surface thereof and the adjacent exterior surface of said second mailbox side with a part of the outermost convolution of said coiled first end of said second indicator extending through said peripheral opening of said embossed projection of said second plate and the remainder of said second indicator being located exteriorly thereof, and means to anchor the endmost portion of said first coiled end of said second indicator centrally of said embossed projection of said second plate.

8. The structure claimed in claim 5 wherein the enlarged elements of said first mentioned indicator and said second indicator are both three-dimensional.

9. The structure claimed in claim 8 wherein said enlarged elements of said first mentioned indicator and said second indicator differ from each other in color.

* * * * *